US010732663B2

(12) United States Patent
Lenfert et al.

(10) Patent No.: US 10,732,663 B2
(45) Date of Patent: Aug. 4, 2020

(54) REMOVABLE KNOB AND KNOB ASSEMBLY

(71) Applicant: Honda Motor Co., Ltd., Minato-ku, Tokyo (JP)

(72) Inventors: Nathaniel Artemis Lenfert, Graham, NC (US); Timothy Justin Johnson, Greensboro, NC (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/937,225

(22) Filed: Mar. 27, 2018

(65) Prior Publication Data

US 2019/0302826 A1 Oct. 3, 2019

(51) Int. Cl.
*G05G 1/06* (2006.01)

(52) U.S. Cl.
CPC ..... *G05G 1/06* (2013.01)

(58) Field of Classification Search
CPC ..... G05G 1/06; G05G 1/04; G05G 1/085; G05G 1/12; F16H 59/0278; Y10T 16/469; Y10T 16/506; Y10T 74/20762; Y10T 74/20732; Y10T 74/20612
See application file for complete search history.

(56) References Cited

U.S. PATENT DOCUMENTS

| | | | | |
|---|---|---|---|---|
| 1,925,030 | A * | 8/1933 | Burke | G05G 1/06 16/446 |
| 1,929,188 | A * | 10/1933 | Kasch | G05G 1/06 16/441 |
| 2,199,018 | A * | 4/1940 | Bahr | F16H 59/0278 16/441 |
| 3,520,212 | A | 7/1970 | Evans | |
| 4,783,884 | A | 11/1988 | Stricker et al. | |
| 5,588,329 | A | 12/1996 | Nedachi | |
| 5,806,378 | A | 9/1998 | Friedman | |
| 6,058,797 | A | 5/2000 | Konig et al. | |
| 6,168,343 | B1 | 1/2001 | Botella et al. | |
| 6,421,881 | B1 | 7/2002 | Shovlin | |
| 6,473,940 | B1 | 11/2002 | Cooper | |
| 6,910,827 | B2 | 6/2005 | Maloof et al. | |
| 8,256,324 | B2 | 9/2012 | Laming et al. | |
| 8,468,906 | B2 | 6/2013 | Shioji et al. | |
| 9,435,427 | B2 | 9/2016 | Miyamoto et al. | |
| 9,441,728 | B2 | 9/2016 | Nishijima et al. | |
| 9,528,598 | B2 | 12/2016 | Farkas et al. | |
| 2006/0123943 | A1 * | 6/2006 | Huber | F16H 59/0278 74/543 |

(Continued)

FOREIGN PATENT DOCUMENTS

| | | | | |
|---|---|---|---|---|
| FR | 2216882 | A7 * | 8/1974 | G05G 1/085 |
| WO | WO-0201093 | A1 * | 1/2002 | F16H 59/02 |

*Primary Examiner* — Daniel D Yabut
(74) *Attorney, Agent, or Firm* — Honda Patents & Technologies North America, LLC; Suzanne B. Gagnon

(57) ABSTRACT

A knob for mounting on a control lever includes a knob body and a cavity formed in the knob body extending from a lower end of the knob body having a lower opening. The knob also includes a cantilever arm within the cavity connected to an interior connection portion of the knob body remote from the lower opening and extending substantial parallel to an interior of the knob body to the lower opening. The cantilever arm includes a projection formed on a side of the cantilever arm to engage a connecting portion of the control lever.

20 Claims, 5 Drawing Sheets

(56) References Cited

U.S. PATENT DOCUMENTS

| | | | |
|---|---|---|---|
| 2006/0179967 | A1 | 8/2006 | Egerter et al. |
| 2014/0105677 | A1 | 4/2014 | Spencer |
| 2016/0312881 | A1 | 10/2016 | Morse et al. |

* cited by examiner

REMOVABLE KNOB AND KNOB ASSEMBLY

BACKGROUND

Power equipment, such as lawn mowers, tillers, and snow blowers, are known to have variety of knobs. These knobs are often securely fasten to a control lever and are typically difficult to remove by an operator of the power equipment. If the knob becomes damaged and cannot be removed from the control lever, the operator may need to replace both the knob and the control lever. It would be beneficial for an operator to easily replace a damaged knob with a new knob without having to change out the entire control lever and without the need of additional tools to remove the damaged knob.

APPLICATION SUMMARY

According to one aspect, a knob for mounting on a control lever includes a knob body and a cavity formed in the knob body extending from a lower end of the knob body having a lower opening. The knob also includes a cantilever arm within the cavity connected to an interior connection portion of the knob body remote from the lower opening and extending substantial parallel to an interior of the knob body to the lower opening. The cantilever arm includes a projection formed on a side of the cantilever arm to engage a connecting portion of the control lever.

According to another aspect, a knob assembly includes a knob body and a control lever. The knob body includes a cavity formed in the knob body, and the cavity extends from a lower end of the knob body having a lower opening. The knob body also includes a cantilever arm within the cavity that extends substantially parallel to an interior of the knob body. The cantilever arm includes a projection formed on a side of the cantilever arm and an extended section at an end of the cantilever arm. The control lever includes a shaft including an end portion configured to be received the cavity of the knob body, a connecting portion formed on a base of the shaft, and the connecting portion is configured to engage the projection of the cantilever arm.

According to a further aspect, a knob for mounting on a control lever includes a knob body having a lower body part including a lower end having a lower opening, a cavity formed in the lower body part extending from the lower opening, and a cantilever arm. The cantilever arm is connected to an interior connection portion of the lower body part within the cavity and extending along an axial direction of the lower body part to the lower opening. The cantilever arm includes a projection formed on a side of the cantilever arm to engage a connecting portion of the control lever, and an extended section formed on an end of the cantilever arm to selectively engage and disengage the projection of the cantilever arm from the connecting portion of the control lever.

BRIEF DESCRIPTION OF THE DRAWINGS

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advances thereof, will be best understood by reference to the following detailed description of illustrative embodiments when read in conjunction with the accompanying drawings, wherein:

DETAILED DESCRIPTION

Figure 1:
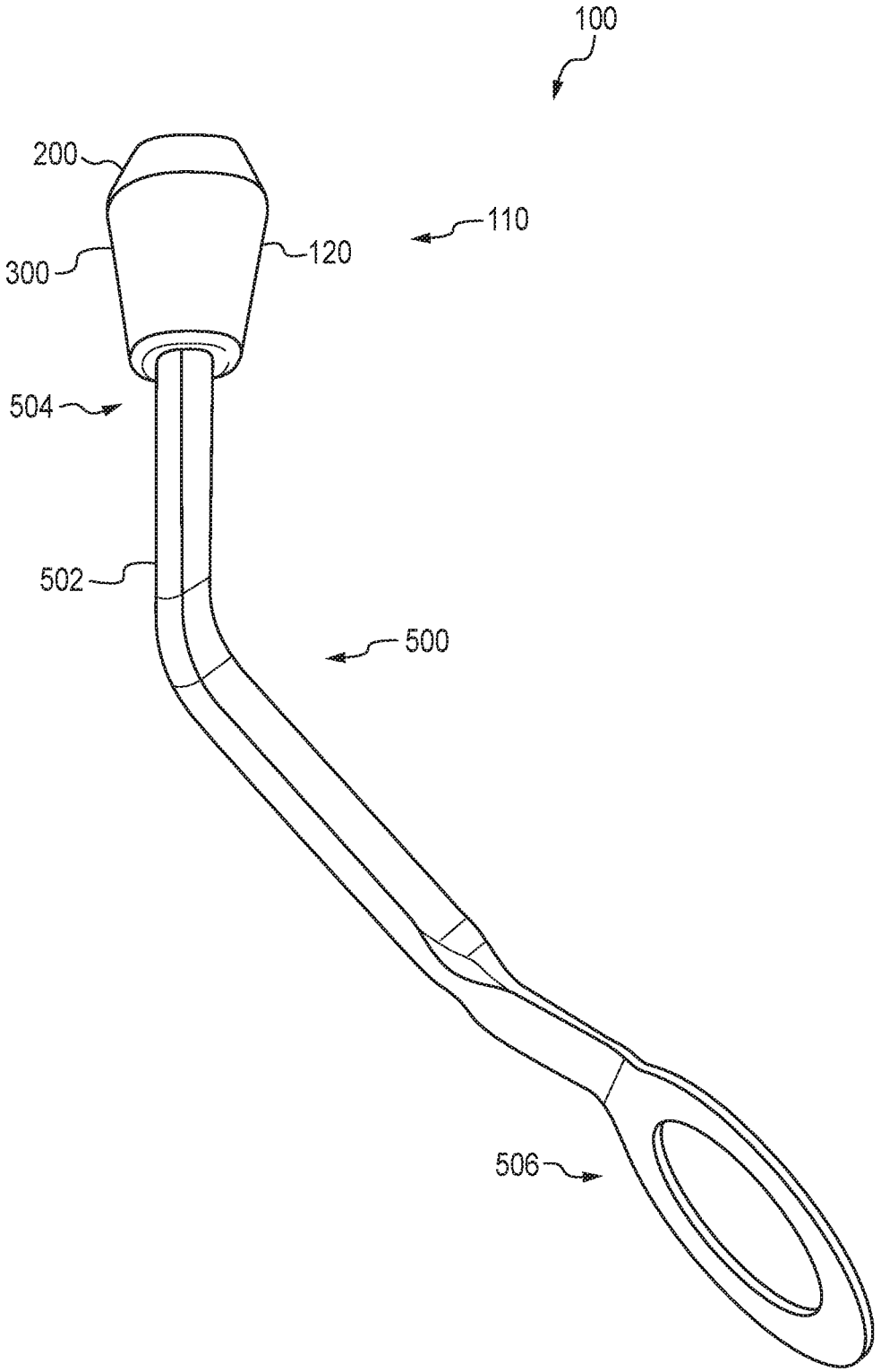
FIG. 1 is a perspective view of a knob assembly according to an exemplary embodiment.

Examples will now be described more fully hereinafter with reference to the accompanying drawings in which example embodiments are shown. Whenever possible, the same reference numerals are used throughout the drawings to refer to the same or like parts. Some aspects may be embodied in many different forms and should not be construed as limited to the embodiments set forth herein.

FIG. 1 illustrates a perspective view of a knob assembly 100 according to an exemplary embodiment. The knob assembly 100 includes a knob 110 with a knob body 120 having an upper body part 200 and a lower body part 300. The knob 110 is mounted on a control lever 500. The control lever 500 includes a shaft 502, which has an upper end 504 attached to the knob body 120 and a lower end 506 configured to attached to a power equipment part (not shown), such as a lawn mower part. As depicted, the knob body 120 is of a general oval tapered shape with the upper body part 200 having a frustum shape and the lower body part 300 having a cylindrical shape. However, the knob body 120, the upper body part 200, and lower body part 300 are not limited to these particular shapes, and can comprise other shapes or arrangements as desired.

Figure 2:
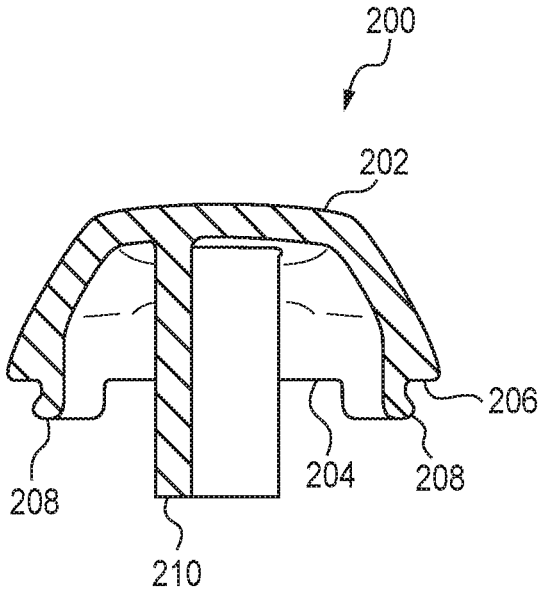
FIG. 2 is a sectional view of a upper body part of a knob according to an exemplary embodiment.

FIG. 2 is a sectional view of the upper body part 200 of the knob body 120 according to an exemplary embodiment. As shown in FIG. 2, the upper body part 200 includes an upper rounded portion 202, a base portion 204, and an outer rim 206 around the perimeter of the base portion 204. The upper body part 200 also has two fastening lips 208 that are diametrically opposed extending from the outer rim 206 of the upper body part 200. In alternative aspects, the upper body part 200 may include more or less fastening lips 208 arranged around the outer rim 206. Each of the fastening lips 208 project outwardly toward an exterior of the upper body part 200. The fastening lips 208 fit into the lower body part 300 to attach the upper body part 200 to the lower body part 300 when the upper body part 200 and the lower body part 300 are joined together.

In one embodiment, the upper body part 200 includes a stopper 210 that extends from a central area of the base portion 204. The stopper 210 may have a U-shaped configuration, but the stopper 210 is not limited to this particular shape and can comprise other shapes or arrangements. The stopper 210 is inserted into the lower body part 300 when the upper body part 200 and the lower body part 300 are joined together.

Figure 3:
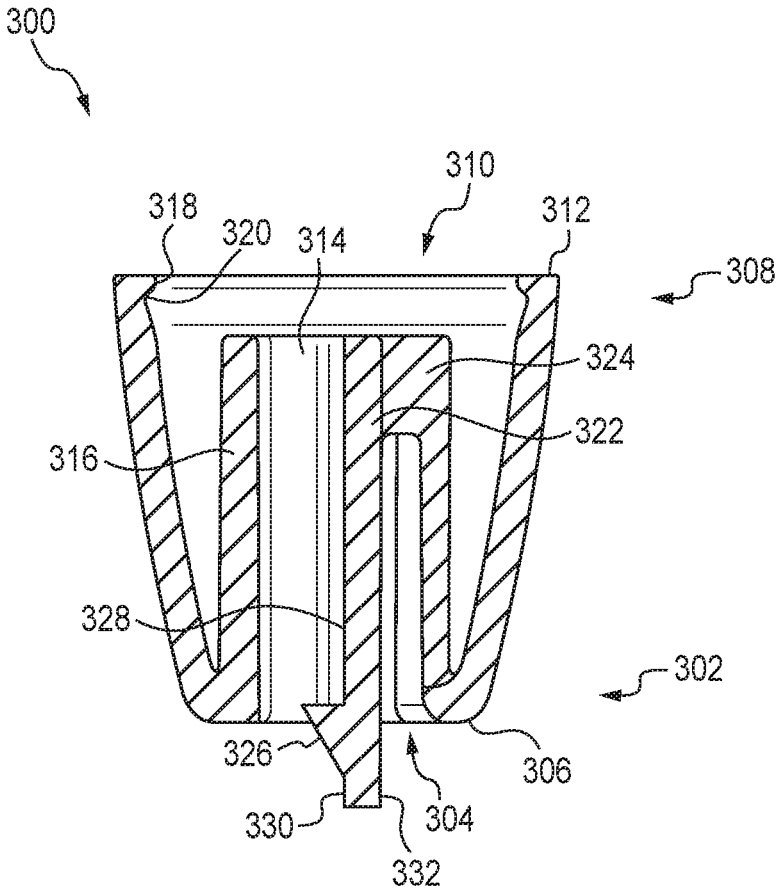
FIG. 3 is a sectional view of a lower body part of a knob according to an exemplary embodiment.

FIG. 3 is a sectional view of the lower body part 300 of the knob body 120 according to an exemplary embodiment. As shown in FIG. 3, the lower body part 300 includes a first lower end 302 having a lower opening 304 with a lower external rim 306 around the perimeter of the lower opening 304 and a second upper end 308 that is opposite the first lower end 302 having an upper opening 310 with an upper external rim 312 around the perimeter of the upper opening 310. The lower body part 300 also include a cavity 314, which extends along an axial direction of the lower body part 300 from the lower opening 304 through an interior 316 of the lower body part 300 to the upper opening 310. The cavity 314 may have a U-shaped configuration extending through the interior 316 of the lower body part 300, but the cavity 314 is not limited to this particular shape and can comprise other shapes or arrangements. In an alternative aspect, rather than the cavity 314 extending from the lower opening 304 to the upper opening 310, a lower cavity may be formed in the lower body part 300 extending from the lower opening 304 and an upper cavity may be formed in the lower body part 300 extending from the upper opening 310.

Figure 4:
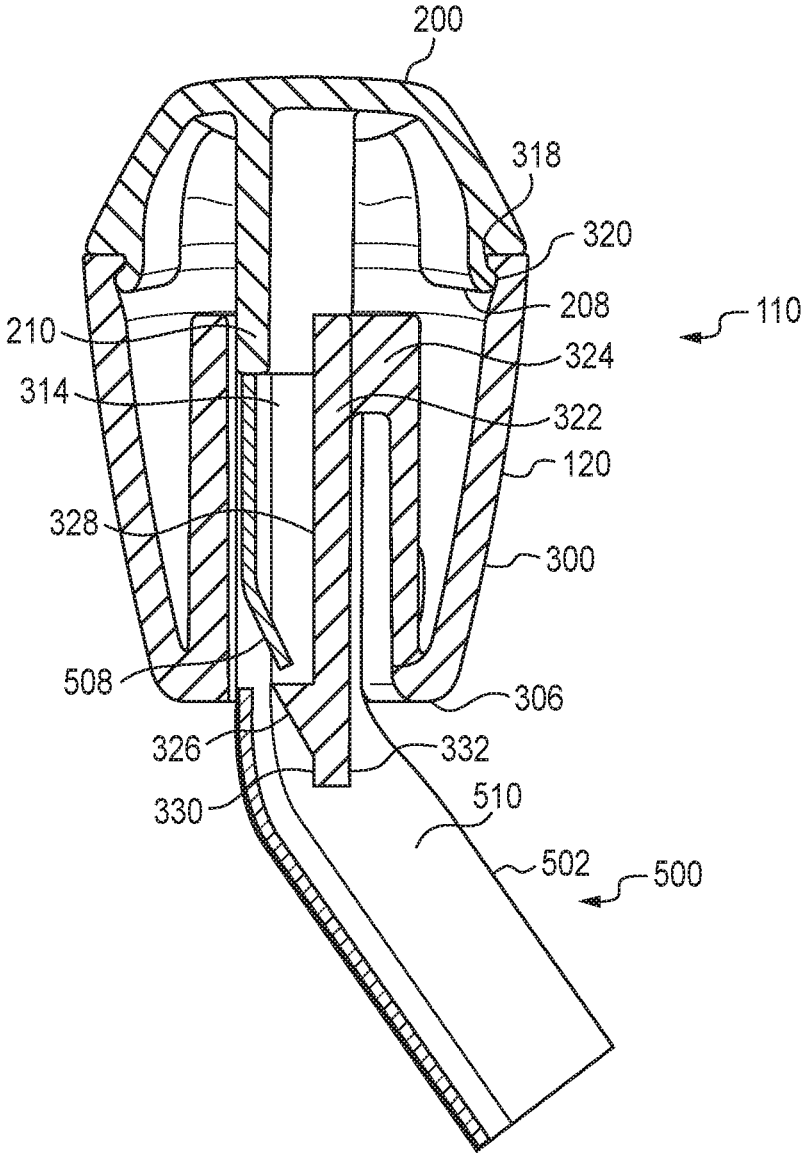
FIG. 4 is a sectional view of a knob mounted on a control lever according to an exemplary embodiment.

In one or more embodiments, the upper external rim 312 of the lower body part 300 contains an inner edge 318 and an internal groove 320 located below the inner edge 318. The fastening lips 208 of the upper body part 200 are configured to snap fit into the internal groove 320 of the lower body part 300 when the upper body part 200 and the lower body part 300 are joined together. This arrangement is illustrated in FIG. 4, which is a sectional view of the knob 110 mounted on the control lever 500 according to an exemplary embodiment. As depicted in FIG. 4, the fastening lips 208 of the upper body part 200 are designed to connect and fit into the corresponding internal groove 320 of the lower body part 300 in a snap fit arrangement to securely attach the upper body part 200 to the lower body part 300 to form the knob body 120.

In one embodiment, the cavity 314 of the lower body part 300 and the stopper 210 of the upper body part 200 have a similar shape configuration allowing for the stopper 210 of the upper body part 200 to fit into the cavity 314 of the lower body part 300. As shown in FIG. 4, the stopper 210 of the upper body part 200 is designed to align and fit into the corresponding cavity 314 of the lower body part 300 enabling the upper body part 200 to be easily aligned with lower body part 300 when the upper body part 200 and the lower body part 300 are joined together.

In the exemplary embodiment, the cavity 314 of the lower body part 300 also includes a resilient cantilever arm 322 therein. The cantilever arm 322 is connected to an interior connection portion 324 within the cavity 314 of the lower body part 300 remote from the lower opening 304 and extends substantially parallel in the axial direction of the lower body part 300 to the lower opening 304. The cantilever arm 322 also includes a projection 326 located on a side 328 of the cantilever arm 322 opposite of the interior connection portion 324. In one embodiment, the cantilever arm 322 includes an extended section 330 located below the projection at an end 332 of the cantilever arm 322, and the extended section 330 may extend beyond the lower opening 304 of the lower body part 300. The projection 326 is depicted as having a hook-like shape, but the projection 326 is not limited to this particular shape and can comprise other shapes or arrangements. As described below, the projection 326 of the cantilever arm 322 is configured to engage a connecting portion 508 of the control lever 500.

Figure 5:
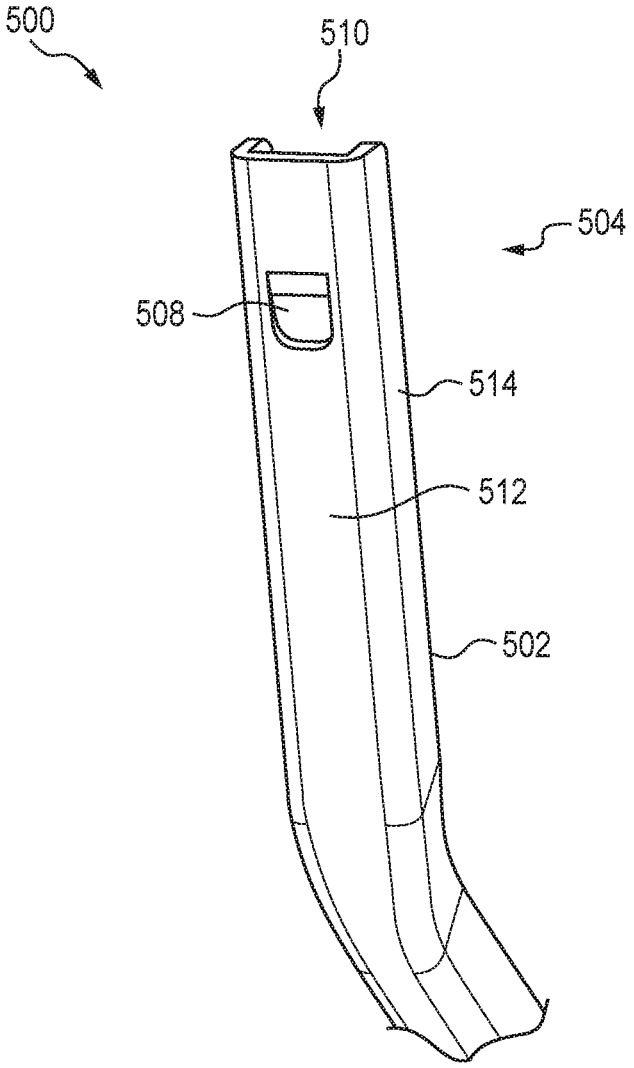
FIG. 5 is a side view of a control lever according to an exemplary embodiment.

FIG. 5 is a side view of the control lever 500 according to an exemplary embodiment. As shown in FIG. 5, the connecting portion 508 of the control lever 500 is formed on the upper end 504 of the shaft 502. Although the connecting portion 508 is illustrated as a protrusion that extends from the shaft 502, the connecting portion 508 can comprise other shapes or arrangements including, for example, an aperture, a hook, or combinations thereof, that is able to engage or interlock with the projection 326 of the cantilever arm 322. In one aspect, the shaft 502 includes a U-shaped channel 510 with walls 514 and a base 512 connecting the walls 514, and the connecting portion 508 extends from the base 512 between the walls 514 of the channel 510.

In one or more embodiments, the cavity 314 of the lower body part 300 receives the shaft 502 of the control lever 500, and the projection 326 of the cantilever arm 322 engages the connecting portion 508 of the control lever 500 when the knob body 120 is mounted on the control lever 500. As depicted in FIG. 4, the projection 326 of the cantilever arm 322 is designed to connect and to securely engage the connecting portion 508 of the control lever 500, for example, in a snap fit arrangement to secure the knob body 120 to the shaft 502 of the control lever 500.

In a further embodiment, the knob body 120 can be removed from the control lever 500 without the need of additional tools by simply utilizing the extended section 330 of the cantilever arm 322 to disengage the projection 326 of the cantilever arm 322 from the connecting portion 508 of the control lever 500. To remove the knob body 120 from the control lever 500, the extended section 330 of the cantilever arm 322 is designed to be lifted or moved away from the shaft 502 of the control lever 500 and toward the lower external rim 306 of the lower body part 300 causing the projection 326 of the cantilever arm 322 to disengage from the connecting portion 508 of the control lever 500.

In one aspect, the cavity 314 also receives the connecting portion 508 of the control lever 500 when the cavity 314 receives the shaft 502, and the projection 326 engages the connecting portion 508 within the cavity 314. As such, the engagement of the projection 326 and the connection portion 508 is protected or guarded by the knob body 120, thereby preventing disengagement from any debris from the surrounding environment or unexpected force on the knob 110.

In another aspect, the cavity 314 of the lower body part 300 and the shaft 502 of the control lever 500 have a similar shape configuration allowing for the shaft 502 of the control lever 500 to fit into the cavity 314 of the lower body part 300. As shown in FIG. 4, when the knob body 120 is mounted on the control lever 500, the shaft 502 of the control lever 500 fits into the corresponding cavity 314 of the lower body part 300, and the cantilever arm 322 of the lower body part 300 is received into the channel 510 of the control lever 500. In such a configuration, the extended portion 330 is also protected or guarded by the walls 514 of the channel 510 from any debris from the surrounding environment or unexpected force on the knob 110.

In an additional aspect, the cavity 314 of the lower body part 300, the shaft 502 of the control lever 500, and the stopper 210 of the upper body part 200 have a similar shape configuration allowing for the shaft 502 of the control lever 500 to fit into the cavity 314 of the lower body part 300 and to abut against the stopper 210 of the upper body part 200 when the knob body 120 is mounted on the control lever 500. As shown in FIG. 4, the shaft 502 of the control lever 500 fits into the corresponding cavity 314 of the lower body part 300, and the upper end 504 of the shaft 502 abuts against the stopper 210 of the upper body part 200 when the connecting portion 508 of the control lever 500 is engaged by the projection 326 of the cantilever arm 322.

In order to form the knob 110, the upper body part 200 is attached to the lower body part 300. The stopper 210 of the upper body part 200 is first aligned with and inserted into the cavity 314 of the lower body part 300, and the upper body part 200 and the lower body part 300 are pressed together until the fastening lips 208 of the upper body part 200 abut the inner edge 318 of the lower body part 300. Then, the fastening lips 208 of the upper body deflect inwardly and slide passed the inner edge 318 into the internal groove 320 of the lower body part 300, thereby enabling the fastening lips 208 of the upper body part 200 to snap fit into the internal groove 320 of the lower body part 300 and forming the knob 110.

The knob 110 is assembled on the control lever 500 by aligning the lower opening 304 of the knob body 120 with the shaft 502 of the control lever 500 and inserting the upper end 504 of the shaft 502 into the corresponding cavity 314 of the knob body 120, such that the cantilever arm 322 of the knob 110 is received between the walls 514 of the control lever 500. Then, the knob body 120 is pressed onto the shaft 502 of the control lever 500 until the shaft 502 abuts the stopper of the knob body 120 and the projection 326 on the cantilever arm 322 of the knob 110 engages the connecting portion 508 on the control lever 500. When the projection 326 of the cantilever arm 322 is engaged with the connecting portion 508 of the control lever 500, the knob body 120 is securely attached on the control lever 500.

The knob 110 is disassembled from the control lever 500 by an operator lifting or moving the extended section 330 of the cantilever arm 322 of the knob in a direction away from the shaft 502 of the control lever 500 and toward the lower external rim of the knob body 120, thereby disengaging the projection 326 on the cantilever arm 322 from the connecting portion 508 of the control lever 500. Then, the knob body 120 is moved toward the end of the shaft 502 of the control lever 500 until the knob 110 is removed from the control lever 500.

It will be appreciated that various implementations of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A knob for mounting on a control lever, comprising:

a knob body, a cavity formed in the knob body, the cavity extending from a lower end of the knob body having a lower opening, and a cantilever arm within the cavity, the cantilever arm is connected to an interior connection portion of the knob body remote from the lower opening and freely extends substantial parallel to an interior of the knob body from the interior connection portion to the lower opening, the cantilever arm comprising a projection formed on a side of the cantilever arm to engage a connecting portion of the control lever, wherein the projection of the cantilever arm is configured to engage the connecting portion of the control lever within the cavity of the knob body, and the cantilever arm is configured to be disposed within a channel of the control lever.

2. The knob of claim 1, wherein the cantilever arm further comprises an extended section formed on an end of the cantilever arm to selectively engage and disengage the projection of the cantilever arm from the connecting portion of the control lever.

3. The knob of claim 2, wherein the extended section of the cantilever arm extends beyond the lower opening and is lifted by a user to disengage the projection of the cantilever arm from the connecting portion of the control lever.

4. The knob of claim 3, wherein the projection is formed on the side of the cantilever arm opposite from the interior connection portion.

5. The knob of claim 1, wherein the knob body comprises an upper body part and a lower body part; the upper body part includes an upper portion and a base portion with an outer rim; and the lower body part includes the lower end with the lower opening and an upper end opposite the lower end having an upper opening with an external rim, and wherein a part of the base portion of the upper body part is inserted into the upper opening of the lower body part when the upper body part is attached to the lower body part.

6. The knob of claim 5, wherein the upper body part further includes a stopper extending from the base portion, and the cavity is configured to receive the stopper of the upper body part.

7. The knob of claim 5, wherein the outer rim of the upper body part includes at least one fastening lip extending from the outer rim, and the external rim of the upper opening of the lower body part includes an internal groove configured to receive the at least one fastening lip.

8. The knob of claim 1, wherein the channel is defined by a pair of laterally spaced apart walls and a base connecting the walls on one side with an opening between the walls on an opposite side such that the channel extends along a length of the control lever, wherein the connecting portion of the control lever extends from the base such that when the cantilever arm is engaged with the connecting portion, the cantilever arm is accessible through the opening between the walls.

9. The knob of claim 1, wherein the cantilever arm extends continuously from the interior connection portion to the projection within the cavity in the knob body, and then to an extended section outside the cavity beyond the lower opening, the cantilever arm terminating at the extended section outside the cavity.

10. A knob assembly, comprising:

a knob comprising:

a knob body, a cavity formed in the knob body, the cavity extending from a lower end of the knob body having a lower opening, and a cantilever arm within the cavity, the cantilever arm comprising: a first end connected to an interior connection portion of the knob body remote from the lower opening, a projection formed on a side of the cantilever arm, and an extended section at a second end of the cantilever arm, wherein the cantilever arm freely extends substantially parallel to an interior of the knob body from the first end connected to the interior connection portion to the second end at the lower opening; and a control lever comprising:

a shaft, the shaft including an end portion configured to be received by the cavity of the knob body, and a connecting portion formed on a base of the shaft, wherein the connecting portion is configured to engage the projection of the cantilever arm within the cavity of the knob body, wherein the extended section of the cantilever arm selectively engages and disengages the projection of the cantilever arm from the connecting portion of the control lever such that the knob is removably attached to the control lever; the extended section of the cantilever arm extends beyond the lower opening of the knob body; and the extended section of the cantilever arm is lifted by a user to disengage the projection of the cantilever arm from the connecting portion of the control lever to remove the knob from the control lever.

11. The knob assembly of claim 10, wherein the connecting portion of the control lever comprises a protrusion formed on the base of the shaft and extending between walls of the shaft.

12. The knob assembly of claim 10, wherein the shaft of the control lever comprises a channel and the cantilever arm of the knob is disposed within the channel.

13. The knob assembly of claim 12, wherein the extended section of the cantilever arm is lifted away from the shaft of the control lever to disengage the projection of the cantilever arm from the connecting portion of the control lever.

14. The knob assembly of claim 10, wherein the cantilever arm extends continuously from the interior connection portion to the projection within the cavity in the knob body, and then to the extended section outside the cavity beyond the lower opening, the cantilever arm terminating at the extended section outside the cavity.

15. A removable knob for mounting on a control lever, comprising:

a knob body, the knob body comprising an upper body part and a lower body part including a lower end having a lower opening, a cavity formed in the lower body part extending from the lower opening, and a cantilever arm within the cavity, the cantilever arm comprising:

a first end connected to an interior connection portion of the lower body part remote from the lower opening, a projection formed on a side of the cantilever arm to engage a connecting portion of the control lever within the cavity of the knob body, and an extended section formed on a second end of the cantilever arm to selectively engage and disengage the projection of the cantilever arm from the connecting portion of the control lever, wherein the cantilever arm freely extends along an axial direction of the lower body part from the first end connected to the interior connection portion to the second end at the lower opening.

16. The knob of claim 15, wherein the extended section of the cantilever arm extends beyond the lower opening of the lower body part, and the extended section of the cantilever arm is lifted by a user to disengage the projection of the cantilever arm from the connecting portion of the control lever.

17. The knob of claim 15, wherein the lower body part further includes an upper end having an upper opening with an external rim, and the cavity extends from the lower opening through the interior of the lower body part to the upper opening.

18. The knob of claim 17, wherein the upper body part includes an upper portion, a base portion with an outer rim, and a stopper extending from the base portion, and wherein the cavity of the lower body part is configured to receive the stopper of the upper body part.

19. The knob of claim 18, wherein the outer rim of upper body part includes at least one fastening lip extending from the outer rim, and the external rim of the upper opening of the lower body part includes an internal groove configured to receive the at least one fastening lip.

20. The knob of claim 15, wherein the upper body part comprises a stopper receivable in the cavity in the lower body part, and wherein the control lever abuts the stopper when the projection of the cantilever arm is engaged with the connecting portion of the control lever.

* * * * *